United States Patent [19]

Smith

[11] 3,944,691

[45] Mar. 16, 1976

[54] DECORATIVE ASSEMBLY OR TOY

[76] Inventor: John A. Smith, 1706 W. Dallas, Selma, Ala. 36701

[22] Filed: Apr. 9, 1974

[21] Appl. No.: 459,284

[52] U.S. Cl. ..... 428/13; 35/69; 46/116; 272/8 N

[51] Int. Cl.[2] ..... B44F 7/00

[58] Field of Search ..... 161/18, 12, 19, 20; 35/69; 46/116; 272/8 N; 428/13

[56] References Cited

UNITED STATES PATENTS

| | | | |
|---|---|---|---|
| 2,451,913 | 10/1948 | Brice | 161/18 |
| 2,917,856 | 12/1959 | Soloff | 161/18 |
| 2,925,686 | 2/1960 | Metrulis | 161/20 UX |
| 3,613,265 | 10/1971 | Stern et al. | 161/18 |
| 3,649,423 | 3/1972 | Wilton et al. | 161/18 |
| R23,612 | 1/1953 | Abel | 46/116 |

FOREIGN PATENTS OR APPLICATIONS

| | | | |
|---|---|---|---|
| 440,301 | 10/1948 | Italy | 35/69 |

*Primary Examiner*—William E. Schulz
*Attorney, Agent, or Firm*—Finnegan, Henderson, Farabow & Garrett

[57] ABSTRACT

A decorative assembly or toy consisting of a transparent image of the mascot or other representation symbolic of a first athletic team with the image of the mascot of a second athletic team embedded within the first image in a manner and position to give the appearance of having been devoured by the first image.

4 Claims, 1 Drawing Figure

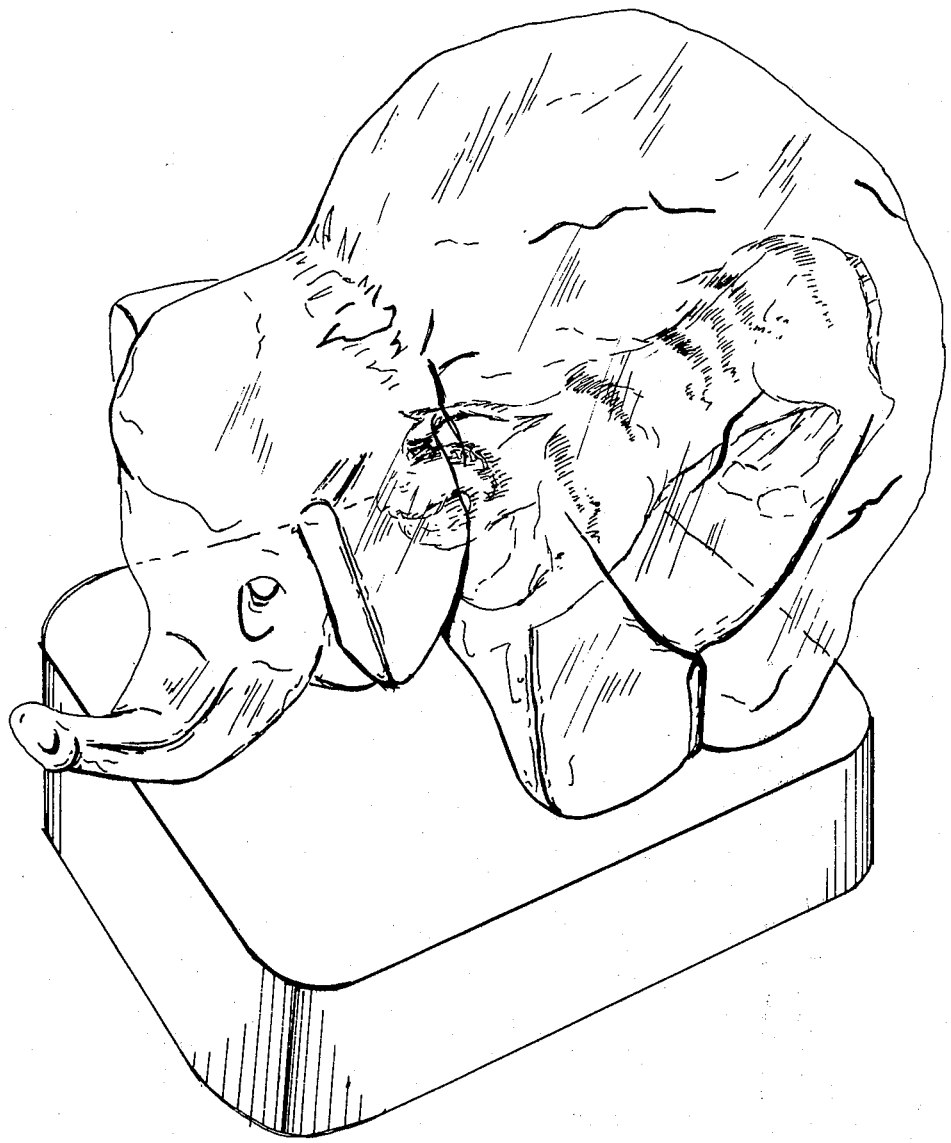

DECORATIVE ASSEMBLY OR TOY

This invention relates to a novel decorative assembly or toy, such as a paperweight or the like, that visibly symbolizes the dominance of one rival athletic team over another.

There exists today in the United States as well as throughout the world much interest in team athletic events from secondary schools through professional sports, and over the years many traditional rivalries have formed between certain competing teams. This interest has sparked an entire industry concerned with the production and sale of novelty items, such as pennants, flags, caps, etc., to fans and spectators so that they can visibly express their support for a particular team.

In accordance with the present invention, there is provided a new and unique type of novelty item or decorative assembly for such purpose that comprises a transparent image of the mascot or symbol of a first athletic team with an essentially opaque image of the mascot or symbol of a second athletic team embedded within said first image in a manner and position to give the appearance of having been devoured by the first image.

With reference to the accompanying drawing which is exemplary and explanatory of the invention, there is shown a transparent image 10, here shown in the form of an elephant, representing the mascot of one athletic team or other representation symbolic of a particular team or educational institution. Preferably, image 10 is a casting of a moldable and transparent synthetic resin, such as a polyester resin, acrylic resin, or other resin commonly used in the production of decorative plastic assemblies.

A second and smaller and essentially opaque image 20, here shown in the form of a tiger, is completely embedded within first image 10 and represents the mascot or symbol of another rival athletic team or institution. In view of the transparent character of the first image, the smaller image or mascot 20 thus appears to have been devoured or swallowed by the first mascot creating an impression of total dominance of the first image over the second. Thus, it can be appreciated that the assembly of this invention visibly conveys the partisan support of its owner or possessor.

Preferably, the smaller image 20 is a casting made from plaster of Paris or the like and suitably painted to represent the desired mascot.

It will be obvious, of course, that other pairs of mascots representing traditional rivals or competing athletic teams can be used in place of those shown without departing from the scope of the present invention.

As shown in the drawing, the mascots are mounted on a pedestal or platform 30 making it suitable as a paperweight and providing a flat surface upon which team slogans, names, or other identifying matter may be placed. Alternatively, the decorative item can be mounted to the base of a pen or pencil holder.

In production the transparent resin is first poured or injected into a suitable mold cavity and before the resin is hardened, the second image 20 is embedded within the body of the first image. The resin is then permitted to harden and fastened to a suitable base member.

The invention in its broader aspects is not limited to the specific details shown and described and departures may be made from such description without departing from the principles of the invention and without sacrificing its chief advantages.

What is claimed is:

1. A decorative assembly comprising a transparent casting made from a moldable and transparent synthetic resin representing an image of a mascot and an opague image of another mascot embedded within said first mascot in a manner and position to give the appearance of having been devoured by said first mascot.

2. The assembly of claim 1, in which the resin is selected from the group consisting of polyester and acrylic resins.

3. The assembly of claim 1, in which the image of the dominated or second mascot is a painted casting made from plaster of Paris.

4. The decorative assembly of claim 1, mounted on a base member.

* * * * *